United States Patent [19]

Yaffe

[11] 4,216,100

[45] Aug. 5, 1980

[54] PENTAERYTHRITOL-FATTY ACID ESTER LUBRICANT COMPOSITION

[75] Inventor: Roberta Yaffe, Beacon, N.Y.

[73] Assignee: Texaco Inc., White Plains, N.Y.

[21] Appl. No.: 930,633

[22] Filed: Aug. 3, 1978

Related U.S. Application Data

[63] Continuation of Ser. No. 728,569, Oct. 1, 1976, abandoned.

[51] Int. Cl.[2] ..... C10M 1/48

[52] U.S. Cl. ..... 252/46.7; 252/56 S

[58] Field of Search ..... 252/47.5, 565, 46.7

[56] References Cited

U.S. PATENT DOCUMENTS

| | | | |
|---|---|---|---|
| 2,764,547 | 9/1956 | Fields | 252/47 X |
| 3,775,321 | 11/1973 | Turnquest et al. | 252/47.5 X |
| 3,779,919 | 12/1973 | Patmore et al. | 252/47.5 X |
| 3,779,921 | 12/1973 | Patmore et al. | 252/47.5 X |
| 3,833,513 | 9/1974 | Fath | 252/565 X |
| 3,929,652 | 12/1975 | Seni et al. | 252/47.5 X |

FOREIGN PATENT DOCUMENTS

| | | | |
|---|---|---|---|
| 28560 | 10/1955 | Fed. Rep. of Germany | 252/47.5 |

*Primary Examiner*—Andrew Metz

*Attorney, Agent, or Firm*—Carl G. Ries; Robert A. Kulason; James J. O'Loughlin

[57] ABSTRACT

Lubricating oil composition comprising a major portion of an aliphatic ester base oil having lubricating properties formed from the reaction of pentaerythritol and an organic monocarboxylic acid containing (a) from about 0.005 to 0.20 percent of a 2,5-bis(alkylthio)-1,3,4-thiadiazole; (b) from about 0.3 to 5 percent of an alkyl or alkaryl phenylnaphthylamine; (c) from about 0.3 to 5 percent of a dialkyldiphenylamine; (d) from about 0.25 to 10 percent of a hydrocarbyl phosphate ester, and (e) from about 0.04 to 2 weight percent of a polyhydroxy-substituted anthraquinone.

7 Claims, No Drawings

PENTAERYTHRITOL-FATTY ACID ESTER LUBRICANT COMPOSITION

This is a continuation of application Ser. No. 728,569 filed Oct. 1, 1976, now abandoned.

BACKGROUND OF THE INVENTION

1. Field of the Invention

This invention is concerned with a pentaerythritol ester base lubricating oil composition for a gas turbine engine. Gas turbine engines are operated under a wide range of temperature conditions. The lubricant must be fluid at extremely low temperatures and at the same time retain its lubricating properties in an engine which produces internal operating temperatures of 450–550° F. or above. The lubricant is subjected to severe oxidation stresses under the high running temperatures encountered in such engines.

Ester base lubricating oil compositions prepared from pentaerythritol and a mixture of fatty acids containing selective additive combinations are well known. These lubricants are functional over a wide temperature range and exhibit good thermal and oxidative stability. The search for a still more effective, long lived ester base lubricant composition, however, is a major goal of lubricant manufacturers. In addition, more advanced gas turbine engines currently being developed and tested will put higher stresses on the lubricant composition and are projected to require improved lubricant compositions.

2. DESCRIPTION OF THE PRIOR ART

U.S. Pat. No. 3,719,126 discloses a lubricating oil composition which is non-corrosive to silver and silver alloys containing an oil-soluble polysulfide derivative of 2,5-dimercapto-1,3,4-thiadiazole.

U.S. Pat. No. 3,756,952 discloses an ester base lubricating oil composition containing an ammonium thiocyanate in combination with a polyhydroxy-substituted anthraquinone.

U.S. Pat. No. 3,247,111 discloses an ester base lubricating oil composition containing phenyl-naphylamine, dioctyldiphenylamine and quinizarin.

British Pat. No. 1,180,387 discloses an ester base lubricating oil composition containing an alkylated diphenylamine, alkylated phenyl naphthylamine and a neutral organic phosphate.

SUMMARY OF THE INVENTION

The lubricating oil composition of the invention comprises a major portion of an aliphatic ester base oil having lubricating properties containing a bis(alkylthio)-1,3,4-thiadiazole, an alkylphenyl or alkarylphenyl naphthylamine, a dialkyldiphenylamine, a hydrocarbyl phosphate, and a polyhydroxy-substituted anthraquinone. More specifically, the lubricating oil composition of the invention comprises a major portion of an aliphatic ester base oil formed from the reaction of a pentaerythritol and an organic monocarboxylic acid having from about 2 to 18 carbon atoms per molecule containing:

(a) from about 0.005 to 0.20 weight percent of a bis(alkylthio)-1,3,4-thiadiazole represented by the formula:

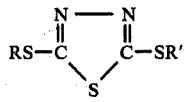

in which R and R′ represent alkyl radicals having from 3 to 14 carbon atoms, (b) from about 0.3 to 5 percent by weight of the lubricating oil composition of alkyl or alkaryl substituted derivatives of phenyl $\alpha$ or $\beta$ naphthylamines in which the alkyl radical and the alkaryl radical have from 4 to 12 and from 7 to 12 carbon atoms respectively, (c) from about 0.3 to 5 percent of dialkyldiphenylamine in which the alkyl radicals have from 4 to 12 carbon atoms, (d) from about 0.25 to 10 percent of a hydrocarbyl phosphate in which said hydrocarbyl radical contains an aryl ring and has from about 6 to 18 carbon atoms, and (e) a polyhydroxy-substituted anthraquinone represented by the formula:

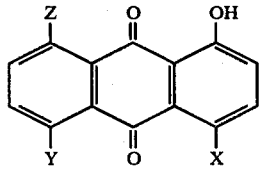

in which X, Y and Z each represent hydrogen or a hydroxyl group and at least one of these is a hydroxyl group.

The novel lubricating oil of the invention provides outstanding thermal and oxidative stability and reduced metal deposits. The results obtained from the use of the novel lubricant composition of the invention were quite surprising since high or poly-sulfur-containing additives were considered heretofore to be too corrosive for an effective ester base lubricant composition.

The base fluid component of the lubricant of the invention is an ester-base fluid prepared from pentaerythritol and a mixture of hydrocarbyl monocarboxylic acids. Polypentaerythritols, such as dipentaerythritol, tripentaerythritol and tetra-pentaerythritol can also be employed in the reaction to prepare the base oil.

The hydrocarbon monocarboxylic acids which are used to form the ester-base fluid include the straight-chain and branched-chain aliphatic acids as well as mixtures of these acids. The acids employed will have from about 2 to 18 carbon atoms per molecule, and preferably from about 5 to 10 carbon atoms. Examples of suitable specific acids are acetic, propionic, butyric, valeric, isovaleric, caproic, decanoic, dodecanoic, tertiary-butylacetic acid and 2-ethylhexanoic acid.

In general, the acids are reacted in proportions leading to a completely esterified pentaerythritol or polypentaerythritol with the preferred ester bases being the pentaerythritol tetraesters. Examples of such commercially available tetraesters include pentaerythritol tetracaproate, which is prepared from purified pentaerythritol and crude caproic acid containing other $C_{5-10}$ monobasic acids. Another suitable tetraester is prepared from a technical grade pentaerythritol and a mixture of acids comprising 38 percent valeric, 13 percent 2-methyl pentanoic, 32 percent octanoic and 17 percent pelargonic acids.

The pentaerythritol ester base comprises the major portion of the formulated synthetic ester base lubricating oil composition. In general, this ester base fluid is present in a concentration ranging from about 90 to 98 percent of the formulated lubricating oil composition.

The essential bis(alkylthio)-1,3,4-thiadiazole component of the lubricating oil composition of the invention is represented by the formula:

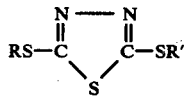

in which R and R' represent aliphatic hydrocarbon radicals having from 3 to 14 carbon atoms. R and R' may be radicals of the same or different carbon chain lengths. The preferred radicals represented by R and R' are alkyl radicals having from 5 to 10 carbon atoms.

In general, the bis(alkylthio)-1,3,4-thiadiazole may be readily prepared in high yield and suitable purity by reaction of commercially available 2,5-dimercapto-1,3,4-thiadiazole with 2 molar equivalents of an alkali metal hydroxide, such as sodium or potassium hydroxide, in a polar medium such as an alcohol, followed by treatment with a haloalkyl compound such as an alkylchloride or alkylbromide. After filtration of the cooled reaction mixture, the product is isolated by vacuum stripping of the solvent.

The alkyl chloride or alkylbromide may be any $C_3$–$C_{14}$ alkyl bromide or chloride.

The folowing example illustrates the preparation of the compound 2,5-bis(n-hexylthio)-1,3,4-thiadiazole:

EXAMPLE I 2,5-bis(n-hexylthio)-1,3,4-thiadiazole was prepared in over 70% yield by reaction of 50 g. (0.32 mole) commercial 2,5-dimercapto-1,3,4-thiadiazole with 26.4 g (0.66 mole) sodium hydroxide in 400 ml refluxing isopropanol followed by the addition of 110 g (0.66 mole) 1-bromohexane. After removal of the solid precipitate (sodium bromide), 71.7 g of product was isolated by vacuum stripping. The product was used without further purification.

The essential alkyl or alkaryl phenyl naphthylamine component of the invention is represented by the formula:

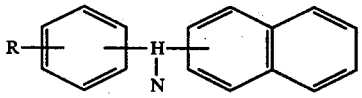

in which R is an alkyl or alkaryl radical in which the alkyl radical and the alkaryl radical have from 4 to 12 and from 7 to 12 carbon atoms respectively. This radical can be a straight or a branched chain alkyl radical with the tertiary alkyl structure being preferred or it can be an alkaryl radical. The naphthylamine can be either an alpha or beta naphthylamine. Specific effective compounds of this class include N-(p-t-octylphenyl)α-β-naphthylamine, N-(4-cumylphenyl)-6-cumyl-B-napthylamine, N-(p-t-octyl-phenyl)-α-βnaphthylamine and the corresponding p-t-dodecyl-phenyl, p-t-dodecylphenyl, p-t-butylphenyl, and p-dodecyl-phenyl-α-and -β-naphthylamines. The preferred naphthylamines are those in which R is a tertiary alkyl radical having from 6 to 10 carbon atoms. The preferred concentration of this component is from about 0.5 to 2.5 percent.

Another essential component of the lubricating oil composition of the invention is a dialkyldiphenylamine. These compounds are represented by the formula:

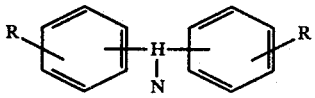

in which the R is an alkyl radical having from about 4 to 12 carbon atoms. Suitable alkylamines include dioctyldiphenylamine and similar compounds.The preferred class of dialkyldiphenylamines are those in which R is an alkyl radical having from 8 to 10 carbon atoms. Dioctyldiphenylamine is the preferred compound and the preferred concentration is from 0.5 to 2.0 percent.

The essential hydrocarbylphosphate ester, more specifically, a trihydrocarbyl phosphate, has the formula $(RO)_3$ PO in which R is a hydrocarbyl radical i.e. an aryl or alkaryl radical or mixture thereof having from about 6 to 18 carbon atoms and preferably from 8 to 12 carbon atoms. Effective specific compounds include tricresylphosphate, cresyl diphenylphosphate and triphenylphosphate. These compounds are employed in the lubricating oil composition in a concentration ranging from about 0.5 to 5 percent.

The final essential component of this lubricant composition is a polyhydroxy-substituted anthraquinone inhibitor represented by the formula:

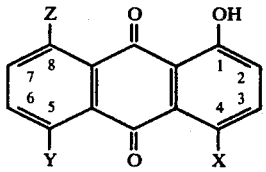

in which X, Y and Z each represent hydrogen or a hydroxyl group and at least one of these is a hydroxyl group. There is criticality in the structure of the polyhydroxy-substituted anthraquinone. This compound must have at least two hydroxyl groups and both of these must be attached to the ring carbon atoms in the alpha position to the quinone rings, i.e. on positions 1,4,5 and 8. Additional hydroxyl groups may be present without changing the effectiveness of the noted compounds.

Examples of effective polyhydroxy-substituted anthraquinones include 1,4-dihydroxyanthraquinone 1,5-dihydroxyanthraquinone, 1,2,4-trihydroxyanthraquinone and 1,2,5,8-tetrahydroxyanthraquinone.

The oxidation stability of the lubricating oil composition of the invention was determined in the Rolls Royce(RR1001 Oxidation) Test.*

*D. Eng. R.D. 2497 Supplement Method No. 12.

The ester base oil employed in preparing the lubricating oil composition of the invention comprised pentaerythritol containing a minor amount of dipentaerythritol esterified with a mixture of fatty acids. The base oil consisted of technical grade pentaerythritol ester made from a mixture of carboxylic acid consisting of (mole %):

| | |
|---|---|
| i - $C_5$ | 8 ± 3% |
| n - $C_5$ | 23 ± 5 |

-continued

| | |
|---|---|
| n - $C_6$ | 20 ± 5 |
| n - $C_7$ | 27 ± 5 |
| n - $C_8$ | 7 ± 3 |
| n - $C_9$ | 16 ± 3 |

This ester base oil had the following properties:

| | |
|---|---|
| Viscosity, cs at 210° F. | (5.01) |
| Viscosity, cs at 100° F. | (25.6) |
| Viscosity, cs at −40° F. | (7005) |
| Viscosity Index | (140) |
| Flash, °F. | (515) |

The above base oil was blended with all of the prescribed essential additives with the exception of the bis(alkylthio)-1,3,4-thiadiazole to form a Base blend. Based on a fully formulated lubricant composition, the Base blend consisted of about 95.4 weight percent of the ester base oil described above with 1,5 weight percent of t-octyl-phenyl-α-napthylamine, 1.0 weight percent of dioctyl-diphenylamine, 2.0 weight percent of tricresylphosphate and 0.1 weight percent of quinizarin.

The oxidation-stability of the lubricant of the invention as compared to the base blend was determined in the Rolls Royce (RR1001) Oxidation Test. The results are set forth in the following Table.

TABLE

ROLLS-ROYCE(RR1001) OXIDATION TEST*
(260° C./6hr)

| Run | Additive | TAN Increase | % Viscosity Increase at 100° F. |
|---|---|---|---|
| 1. | Base Blend | 4.76 | 81.9 |
| 2. | Base Blend + 0.1 wt % 2,5-bis (n-hexylthio)1,3,4-thiadiazole | 3.42 | 32.7 |

*D. Eng. R.D. 2497 Supplement Method No. 12

The foregoing tests show that the novel lubricating oil composition of the invention has been remarkable improved in its resistance to oxidation. In comparison to the Base Blend the lubricating oil composition exhibited a reduction in TAN (Total Acid Number) Increase of about 25 percent. More significantly, the lubricant of the invention exhibited a dramatic reduction in Viscosity Increase as compared to the Base Blend. This reduction in Viscosity Increase amounted to approximately a 60 percent reduction in Viscosity Increase as compared to the Base Blend.

The lubricating oil composition of the invention was also tested in the 425° F. Oxidation and Corrosion Test, the 375° F. SOD Lead Corrosion Test and the 410° F. Stainless Steel Corrosion Test and was found to qualify against the requirements of major engine manufacturers as well as military specifications.

The prescribed ester base lubricating oil compositions are novel compositions not heretofore taught or suggested in the prior art. The discovery that a poly-sulfur containing additive could be employed in an ester base lubricant composition having non-corrosive properties was most surprising since the poly-sulfur-containing additives are normally extremely corrosive when employed in a synthetic lubricating oil composition.

I claim:

1. A lubricating oil composition comprising a major portion of an aliphatic ester base oil having lubricating properties formed from the reaction of pentaerythritol and a saturated hydrocarbyl monocarboxylic acid having from about 2 to 18 carbon atoms per molecule, containing (a) from about 0.005 to 0.20 weight percent of a bis(alkylthio)-1,3,4-thiadiazole represented by the formula:

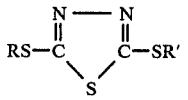

in which R and R′ represent alkyl radicals having from 3 to 14 carbon atoms, (b) from about 0.3 to 5 percent by weight of the lubricating oil composition of an alkyl or alkaryl substituted phenyl naphthylamine in which the alkyl radical and the alkaryl radical have from 4 to 12 and from 7 to 12 carbon atoms respectively, (c) from about 0.3 to 5 percent of a dialkyldiphenylamine in which the alkyl radicals have from 4 to 12 carbon atoms, (d) from about 0.25 to 10 percent of a trihydrocarbyl phosphate in which said hydrocarbyl radical contains an aryl ring and contains from about 6 to 18 carbon atoms, and (e) from about 0.04 to 2 weight percent of a polyhydroxy-substituted anthraquinone represented by the formula:

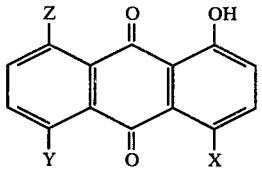

in which X, Y and Z each represent hydrogen or a hydroxyl group and at least one of these is a hyroxyl group.

2. A lubricating oil composition according to claim 1 in which R and R′ have from 5 to 10 carbon atoms.

3. A lubricating oil composition according to claim 1 containing from about 0.05 to 0.1 weight percent of said bis(alkylthio)-1,3,4-thiadiazole.

4. A lubricating oil composition according to claim 1 in which said bis(alkylthio)-1,3,4-thiadiazole is 2,5-bis(n-hexylthio)-1,3,4-thiadiazole.

5. A lubricating oil composition according to claim 1 in which said bis(alkylthio)-1,3,4-thiadiazole is 2,5-bis(n-butylthio)-1,3,4-thiadiazole.

6. A lubricating oil composition according to claim 1 in which said bis(alkylthio)-1,3,4-thiadiazole is 2,5-bis(n-octylthio)-1,3,4-thiadiazole.

7. A lubricating oil composition according to claim 1 containing t-octylphenyl naphthylamine, dioctyldiphenylamine, tricresylphosphate and quinizarin.

* * * * *